US006062969A

United States Patent [19]

Klicpera

[11] Patent Number: 6,062,969

[45] Date of Patent: May 16, 2000

[54] GRINDING WHEEL WITH SPIRAL GROOVED FACE

[75] Inventor: Udo Klicpera, Pfronten Im Allgau, Germany

[73] Assignee: Kopp Werkzeugmaschinen GmbH, Neu-Ulm, Germany

[21] Appl. No.: 09/132,569

[22] Filed: Aug. 11, 1998

[51] Int. Cl.[7] ..... B24D 11/00

[52] U.S. Cl. ..... 451/548; 125/13.01; 451/56

[58] Field of Search ..... 451/47, 548, 540, 451/541, 56, 72, 161; 125/13.01, 12; 407/24, 26, 28, 23

[56] References Cited

U.S. PATENT DOCUMENTS

| | | | |
|---|---|---|---|
| 2,763,105 | 9/1956 | Feeley | 451/541 |
| 3,708,925 | 1/1973 | Ainoura | 451/541 |
| 4,226,055 | 10/1980 | Komanduri et al. | 451/56 |
| 4,799,337 | 1/1989 | Kotthaus | 451/47 |
| 5,495,844 | 3/1996 | Kitajima et al. | 451/541 |
| 5,720,584 | 2/1998 | Sijtstra | 451/47 |
| 5,823,857 | 10/1998 | Tan | 451/47 |

*Primary Examiner*—Derris Holt Banks
*Attorney, Agent, or Firm*—Jacques M. Dulin; Robert F. Dennis

[57] ABSTRACT

A grinding wheel is disclosed with a disk-like, cylindrical shape, whose perimeter is equipped with a grinding abrasive and has at least one spiral groove. The groove extends essentially around the perimeter at an acute bevel angle of inclination less than 45° to a radius line normal to the axis of wheel rotation. Preferably the bevel angle is designed as an acute angle and is sized so that the groove extends over at least one full circumference of the grinding wheel. The face of the ribs may be tapered and the corners chamfered. Multiple parallel or non-parallel grooves may be employed. Improved cutting, service life and surface characteristics of the processed workpiece are obtained.

16 Claims, 1 Drawing Sheet

GRINDING WHEEL WITH SPIRAL GROOVED FACE

DESCRIPTION

1. Technical Field

The invention pertains to a disc-shaped grinding and/or dressing wheel having at least one spiral groove inclined at an acute angle to the radius which is normal to the axis of rotation. The angle of inclination should be less than 45°, and the cutting ribs can have a tapered face or have chamfered edges. Improved workpiece material removal, service life and grind quality are obtained using the spiral groove grinding wheels of the invention.

2. Background of the Art

Grinding wheels with and without grooves are known. Furthermore, it is known that due to better cooling of the grinding wheel and of the workpiece, due to shorter contact times of the abrasive grain with the surface of the workpiece, and of course, due to greater cutting depths, the cutting performance of grinding wheels can be improved.

If high cutting rates are required, then frequently cog disk wheels are used which have ring grooves. Sometimes these wheels are used in an infeed (perforation) process and sometimes in a side cutting method.

Due to the grooves, a better cooling of the grinding wheel or of the tool is ensured due to an improved flow of coolant. Furthermore, due to the grooves, the removal of grinding dust and abraded material from the workpiece are improved.

However, ring grooves which are orthogonal to the wheel axis of rotation have the disadvantage that the grinding wheels have to be applied several times in numerous processing steps and subsequently, the surface has to be treated by longitudinal grinding (lateral movement of the wheel relative to the workpiece).

From DE-OS 2,758,285 a grinding wheel is known in which two grooves extend across the perimeter in a zig-zag shape. The grooves are positioned so that they intersect over the entire perimeter of the grinding wheel at about the middle (viewed in the axial direction) of the grinding wheel.

It has been discovered that the problems associated with use of orthogonal ring grooves indeed do not occur in a grinding wheel having zig-zag intersecting grooves according to DE-OS 2,758,285. Nevertheless, such zig-zag intersecting groove grinding wheels cannot always satisfy the severe demands of processing quality. This is attributable to the fact that the metal cutting power fluctuates across the width of the intersecting groove grinding wheel. Both the points of intersection of the grooves, and also the reversal points of the grooves are located in a particular area of the wheel perimeter surface, which means that the metal cutting power in the vicinity of this perimeter area differs from the metal cutting power of a neighboring region, and thus a non-uniform grinding result is obtained. This problem is like that for grinding wheels with parallel orthogonal ring grooves in numerous grinding tasks. In order to obtain an acceptable grinding result for zig-zag wheels, longitudinal grinding must be used, i.e., relative axial movement of the wheel and work piece with respect to each other so ribs or bumps are not produced in the workpiece.

The invention addresses and provides a solution to the long-known problem of creating a grinding wheel that will have a long service life with good metal cutting power and good grinding results.

The Invention

Summary

The invention comprises a grinding or dressing wheel having at least one spiral groove around its periphery which groove is inclined at an acute angle to the radius (also called a bevel angle), which is normal to the axis of rotation. The bevel angle of inclination is less than 45° and the peripheral surface or walls of the cutting ribs can be tapered, or the intersecting wall and face edges chamfered.

By using the inventive spiral groove configuration for a grinding wheel the above problem with zig-zag intersecting groove wheels is avoided and the problems underlying the invention are solved. According to the inventive configuration, the grinding wheel has a disk-like, cylindrical shape whose perimeter is provided with a grinding abrasive and at least one groove. This groove extends essentially in the circumferential direction (around the wheel periphery), at a bevel angle of less than 45° between the radius or opposed flat faces of the wheel disc. That is, the groove extends more or less obliquely over the perimeter of the grinding wheel. When processing the workpiece, therefore, the entire region in the width of the grinding wheel is ground, and in contrast to orthogonal ring grooves, a longitudinal grinding or multiple piercing is not needed.

For most grinding tasks a groove angle of less than 30°, often even less than 20, has proven useful. In grinding tasks on sensitive workpieces, an even smaller angle, in the range of a few degrees up to 15°, is preferred, since at such small angles, only negligible transverse (axial) forces are applied from the grinding wheel to the workpiece.

Preferably the groove bevel angle is an acute angle, so that on wider grinding disks, a spiral-shaped groove extending around the entire perimeter and/or axial length (wheel thickness) of the grinding wheel is obtained.

The bevel angle and the width of the grinding disk in the axial direction can be preselected for size so that the groove extends over at least one full circumference, or several times over the circumference of the grinding wheel.

Several grooves can be provided which can extend parallel to each other, or not parallel to each other. A parallel arrangement has the advantage that no points of intersection are produced, but a non-parallel arrangement has the advantage that the grooves can be arranged so that the forces applied by the grinding wheel disk to the workpiece are at least partly compensated. In this regard, the grooves are run in opposite directions.

If two grooves are used that have the same size, but differently oriented bevel angle, then a complete compensation of the produced forces will occur. The bevel angle of the grooves in the case of non-parallel grooves, can be selected so that resulting points of intersection of the grooves do not rest on a perimeter line (i.e., a circumferential line swept out by a radius normal to the rotation axis), but rather are offset to the side, that is, in the axial direction. This has the advantage that the metal cutting power does not fluctuate much across the width of the grinding wheel. The bevel angle can also be selected so that the points of succession intersection will migrate small distances across the width of the grinding wheel, so that a very consistent metal cutting power is obtained.

The sides and perimeter faces of the grinding wheel ribs between the grooves can be provided on one side or both groove sides with a straight cut. However, the ribs can also be provided with a chamfer. The sharp edges which are produced in a straight cut, while exhibiting high metal cutting power also wear out rather quickly. While the grinding disk can indeed continue in use, it has to be adjusted, e.g., by dressing, in which case the production process has to be interrupted. Furthermore, sharp edges have a tendency of splintering or fragmentation. Due to the wear of the edge a contour can be produced in the wheel peripheral surface which is not the optimum with regard to metal cutting power and service life.

It is therefore an advantage, at least in certain cases, to provide at least a portion of the rib face with a taper in order in this manner to have a precisely defined bevel of the edge right from the beginning. The described problems do not appear in a beveling of this kind and the grinding wheel can be operated longer without adjustment or alignment, and without significantly changing the grinding behavior. Depending on the application of the grinding wheel, it can be an advantage to provide a taper of this kind from each rib edge (juncture with the groove side wall) toward the center of the rib.

Results similar to use of a taper at the ribs are attained with a chamfer with a particular radius at the intersection of the groove wall and rib surface. If a radius is used, then this has the advantage that a gentle transition of the grinding of the ribs is obtained which is entirely free of sharp edges. Depending on the application of this grinding wheel it may be helpful to provide only one or both sides (corners) of the rib with a radius.

The grinding wheel can have a particular contour at the perimeter in order to produce a corresponding, opposing contour on the workpiece by perforation grinding. Likewise, the groove sidewalls forming the rib(s) can be tapered, i.e. need not be straight and normal to the axis.

The grooves can be formed in the grinding wheel during manufacture of the wheel or subsequently retrofit, for example, by means of a diamond wheel to cut the grooves and rib contour (taper and/or chamfer). For initial manufacture the grinding wheel starts with a grooved base element which is then coated with grinding abrasive such as corundum, carbides, boron nitride or diamond. A grinding wheel of this kind can be a CBN, ceramic or synthetic resin-bonded disk.

BRIEF DESCRIPTION OF THE DRAWINGS

The drawings illustrate several embodiments of the invention in which.

DETAILED DESCRIPTION OF THE BEST MODE OF THE INVENTION

The following detailed description illustrates the invention by way of example, not by way of limitation of the principles of the invention. This description will clearly enable one skilled in the art to make and use the invention, and describes several embodiments, adaptations, variations, alternatives and uses of the invention, including what I presently believe is the best mode of carrying out the invention.

In this regard, the invention is illustrated in the several figures, and is of sufficient complexity that the many parts, interrelationships, and sub-combinations thereof simply cannot be fully illustrated in a single patent-type drawing. For clarity and conciseness, several of the drawings show in schematic, or omit, parts that are not essential in that drawing to a description of a particular feature, aspect or principle of the invention being disclosed. Thus, the best mode embodiment of one feature may be shown in one drawing, and the best mode of another feature will be called out in another drawing.

Figure 1:
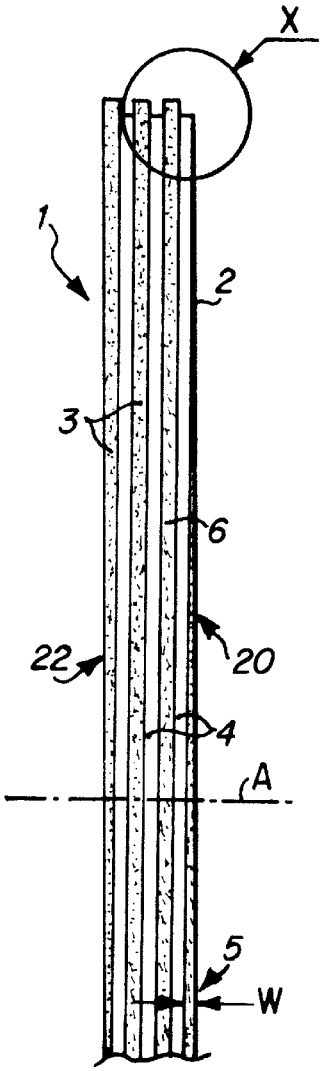
FIG. 1 shows one design example of the grinding wheel in profile view, i.e., grinding surface in side elevation, with axis of rotation, A.

The perimeter face and profile of the grinding disk 1 is presented in elevation in FIG. 1. The grinding wheel 1 has a base element 2 which is equipped with grooves 4 and whose flanking ribs 3 adjoining the grooves 4 are provided with a grinding lining or surface 6. The flat side faces 20, 22 of this exemplary wheel are normal to the axis of rotation of the wheel A.

The illustrated example has a groove 4 which is inclined at a minor angle with respect to the vertical, i.e., at an angle to the radius or side face 20, 22 which are normal to axis A, forming a bevel angle, W. The bevel angle W with respect to the vertical is indicated in region 5. Based on the very acute bevel angle W, which amounts to only about 1.5°, a spiral groove 4, which extends about four times around the perimeter of the grinding wheel 1 is obtained.

The coolant and also the grinding dust are easily removed via the perimeter groove 4. Due to the bevel angle W, it is assured that every region of the workpiece is uniformly processed without any offset of the grinding wheel. Furthermore, due to the acute angle, only a minor transverse force is applied to the workpiece, that is, a force in the axial direction of the grinding wheel. At angles of up to about 5° any transverse force that occurs can be neglected as a practical matter.

Figure 2:
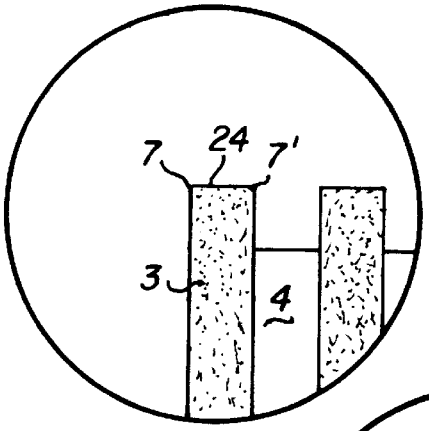
FIG. 2 shows an enlarged detail of one embodiment of the inventive grinding wheel in area X of FIG. 1.

FIG. 2 shows the detail denoted by an X in FIG. 1. FIG. 2 shows an enlargement of the configuration of the edges (corners) of the ribs 3. With this structure, the ribs 3 are provided with a straight cut surface 24 so that sharp 90° edges 7 are produced between the surfaces 24 of the ribs 3 and the adjacent grooves.

Figure 3:
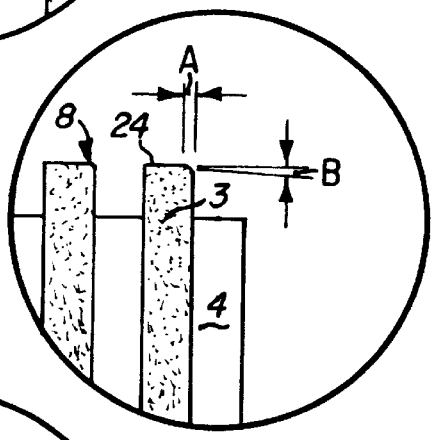
FIG. 3 shows in enlarged detail an alternative, second embodiment of the grooves and ribs of FIG. 2.

FIG. 3 shows an alternative structure in which the surface 24 of ribs 3 are provided on one side with a taper 8. The geometric dimensions of the taper 8 are defined by the height B and the width A, and can extend toward the center of the rib from both corners 7 and 7'.

Figure 4:
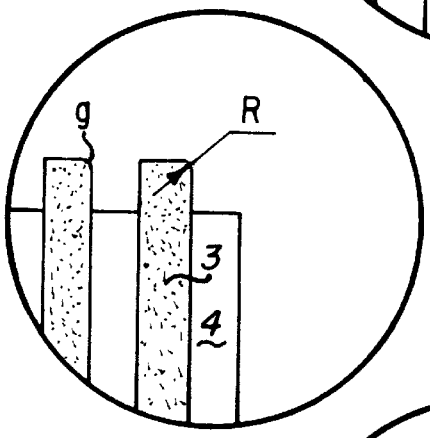
FIG. 4 shows in enlarged detail still another alternative, third embodiment.

FIG. 4 shows an additional alternative where a rounding chamfer 9 is provided instead of the taper 8; this chamfer has a radius R. Based on this rounding, no sharp edges at all are produced in the transition between the faces of the ribs 3.

Figure 5:
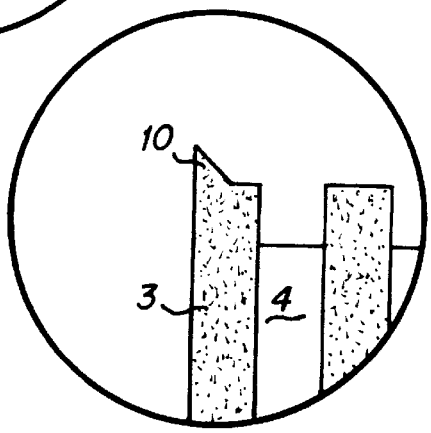
FIG. 5 shows in enlarged detail still another alternative, fourth embodiment.

FIG. 5 shows an alternative configuration which is provided to create a particular contour in the workpiece, in this case, a rib 3 with triangular cross section 10 along at least one surface or edge, by means of penetration grinding.

With regard to the advantages of the described, alternative configurations, the spiral grooves of the invention produce improved workpiece material removal, cooler operation, longer surface life and better ground surface quality. Still other advantages will be evidence from the above description.

It should be understood that various modifications within the scope of this invention can be made by one of ordinary skill in the art without departing from the spirit thereof. I therefore wish this invention to be defined by the scope of the appended claims as broadly as the prior art will permit, and in view of the specification if need be.

I claim:

1. In a grinding wheel comprising a disc-shaped cylindrical body, said body having a first disc end and a second disc end, an axis of rotation, and a generally circumferential face forming a perimeter face for contacting a workpiece, said perimeter face being of preselected width bounded by one of said disc ends on each side of said perimeter face, said perimeter face presents at least one abrasive material and at least one groove in said perimeter face, said groove in said face comprises a pair of groove walls, one of said pair on each side of said groove, said perimeter face being presented on at least one rib, said rib comprises said perimeter face between one of (1) adjacent groove portions and (2) a groove portion and one of said disc ends;

the improvement comprising said groove is oriented in at least a portion of at least one spiral inclined at an acute bevel angle, said bevel angle being defined as the angle between a radial line normal to said axis of rotation and said groove, wherein said perimeter face viewed in cross section through said rotation axis is generally straight, and where said groove walls do not substantially contact said workpiece.

2. An improved grinding wheel as in claim 1 wherein said acute angle is less than 45°.

3. An improved grinding wheel as in claim 2 wherein the bevel angle and perimeter face width in the axial direction are preselected so that said groove extends around said circumference at least once.

4. An improved grinding wheel as in claim 3 wherein said groove spirals around said disc circumference more than once.

5. An improved grinding wheel as in claim 2 wherein at least two grooves are employed which grooves are of the same or different width and are oriented in at least one of, parallel, non-parallel, opposite spiral direction or combinations thereof.

6. An improved grinding wheel as in claim 5 wherein said at least two grooves intersect forming opposed points of intersection in at least one rib, and said rib intersecting points do not lie on a line normal to the axis of rotation of said wheel.

7. An improved grinding wheel as in claim 2 wherein said rib has a profile comprising a first groove side wall, an abrasive perimeter face and a second groove side wall, and at least one of said side walls and said face is straight.

8. An improved grinding wheel as in claim 7 wherein said face is generally parallel to said rotation axis.

9. An improved grinding wheel as in claim 7 wherein said face includes at least one taper with respect to said rotation axis.

10. An improved grinding wheel as in claim 7 wherein at least one juncture of a groove wall and said face is chamfered to form at least one of a rounded corner and a beveled corner.

11. An improved grinding wheel as in claim 7 wherein the portion of at least one rib adjacent at least one of said disc ends has a contoured face to create a mating contour in a workpiece.

12. An improved grinding wheel as in claim 1 wherein said body is grooved and said perimeter face abrasive material is selected from corundum, at least one carbide, boron nitride, diamond or combinations thereof.

13. An improved grinding wheel as in claim 1 wherein said body is selected from CBN, ceramic or synthetic resin.

14. An improved grinding wheel as in claim 12 wherein said body is selected from CBN, ceramic or synthetic resin.

15. A method of making an improved grooved grinding wheel comprising:

a) providing a grinding wheel having a disc-shaped cylindrical body, a generally circumferential face forming a perimeter face which presents at least one abrasive material, and an axis of rotation wherein said perimeter face viewed in cross section through said rotation axis is generally straight; and b) cutting at least one groove in said face oriented in a spiral with respect to said axis of rotation, said spiral being inclined at an acute bevel angle defined between said groove and a radial line normal to said axis of rotation.

16. A method as in claim 15 wherein adjacent grooves form at least one rib there between and said rib includes:

a) a first groove wall, a perimeter face and a second groove wall, and b) said groove cutting includes contouring said rib, said contour being selected from:

i) said face and at least one wall being normal;

ii) said face having at least one taper with respect to said axis of rotation;

iii) the juncture of at least one groove wall and said face being chamfered to provide at least one of a rounded corner and a beveled corner; and iv) combinations thereof.

* * * * *